US010342268B2

(12) United States Patent
Collins

(10) Patent No.: US 10,342,268 B2
(45) Date of Patent: Jul. 9, 2019

(54) GIRDLE WITH DOUBLE CROTCH CONSTRUCTION

(71) Applicant: Agatha S. Collins, Chicago, IL (US)

(72) Inventor: Agatha S. Collins, Chicago, IL (US)

( * ) Notice: Subject to any disclaimer, the term of this patent is extended or adjusted under 35 U.S.C. 154(b) by 0 days.

(21) Appl. No.: 15/456,131

(22) Filed: Mar. 10, 2017

(65) Prior Publication Data

US 2017/0311652 A1 Nov. 2, 2017

Related U.S. Application Data

(60) Provisional application No. 62/391,341, filed on Apr. 28, 2016.

(51) Int. Cl.
*A41C 1/00* (2006.01)
*A41B 9/04* (2006.01)

(52) U.S. Cl.
CPC ..... *A41C 1/00* (2013.01); *A41C 1/003* (2013.01); *A41B 9/04* (2013.01); *A41B 2400/44* (2013.01)

(58) Field of Classification Search
CPC ..... A41B 9/007; A41B 9/08; A41B 9/005; A41B 9/004; A41B 9/026; A41B 2400/44; A41B 2300/322; A41B 9/04; A41C 1/003; A41C 1/00; A41C 1/02; A41C 1/08
USPC ..... 450/102, 104–105, 100, 94, 148, 140, 450/149; 2/78.2, 408
See application file for complete search history.

(56) References Cited

U.S. PATENT DOCUMENTS 1,083,712 A * 1/1914 Uyeda ..... A41B 9/04 2/408
1,247,254 A * 11/1917 Fox ..... A41B 9/08 2/78.2
1,251,439 A * 12/1917 Stause ..... A41B 9/08 2/78.2
1,407,626 A * 2/1922 Bausher ..... A41B 9/08 2/78.2
2,132,610 A * 10/1938 Ellinger ..... A41B 9/08 2/77
2,277,068 A * 3/1942 Bulloch ..... A41B 9/04 2/408
2,363,775 A * 11/1944 Clark ..... A41C 1/003 450/103
2,424,698 A * 7/1947 Lewis ..... A41B 9/04 2/407
2,453,063 A * 11/1948 Cohen ..... A41B 9/04 450/103

(Continued)

FOREIGN PATENT DOCUMENTS

DE 2202330 A1 * 8/1973
GB 449377 * 6/1936

*Primary Examiner* — Alissa J Tompkins
*Assistant Examiner* — Brieanna Szafran
(74) *Attorney, Agent, or Firm* — Fraline J. Allgaier

(57) ABSTRACT

This improved form fitting girdle consists primarily of thigh members having fabric panels being connected to top and bottom crotch pieces. The crotch pieces are a part of the front section and the back section of the girdle. Closing members are positioned along the inner edges of the panels. The closing members fasten the thigh members while leaving an opening between the free edges of the bottom crotch piece and the top crotch piece. The top and bottom crotch pieces have a generally rectangular configuration and overlap in the crotch area of the wearer.

1 Claim, 5 Drawing Sheets

(56) References Cited

U.S. PATENT DOCUMENTS 2,454,963 A * 11/1948 Combs ..... A41B 9/12 450/102
2,468,346 A * 4/1949 Rayden ..... A41C 1/003 2/408
2,490,137 A * 12/1949 Keller ..... A41C 1/003 2/401
2,522,009 A * 9/1950 Wohlman ..... A41C 1/003 2/408
2,617,101 A * 11/1952 Weintraub ..... A41B 9/08 2/408
2,661,002 A * 12/1953 Silverman ..... A61F 5/01 450/102
2,875,763 A * 3/1959 Marchisella ..... A41C 1/06 450/105
2,896,633 A * 7/1959 McKee ..... A41C 1/00 450/102
3,097,651 A * 7/1963 Lehman ..... A41C 1/003 450/102
3,208,455 A * 9/1965 Fridolph ..... A41C 1/00 450/105
3,224,448 A * 12/1965 Diebold ..... A41C 1/003 2/401
3,246,649 A * 4/1966 Krieger ..... A41C 1/003 450/104
3,974,836 A * 8/1976 Carlson ..... A41C 1/003 2/408
4,000,746 A * 1/1977 Fierst ..... A41C 1/003 450/102
4,143,663 A * 3/1979 Williams ..... A41C 1/00 450/103
5,790,984 A * 8/1998 Doubleday ..... A41B 9/005 2/227
6,928,661 B2 * 8/2005 Lewis ..... A41D 1/06 2/227
7,100,214 B1 * 9/2006 Murray ..... A41C 1/003 2/406
2010/0162469 A1 * 7/2010 Parise ..... A41B 9/001 2/400

* cited by examiner

GIRDLE WITH DOUBLE CROTCH CONSTRUCTION

This application claims priority of U.S. Provisional Application Ser. No. 62/391,341 filed Apr. 28, 2016, the entire contents of which are incorporated herein by reference thereto.

BACKGROUND OF THE INVENTION

The present invention relates to a class of feminine undergarment that is generally identified as girdles. This garment is worn for abdominal, crotch and thigh support and is characterized by its provision of a double crotch protective covering that can be opened and closed from the middle section of the thighs.

Girdles were historically considered essential garments for women to control their figure and present a modest and respectable appearance. Over the years, girdles have been produced in numerous types and styles. Most girdles are made of a stretchable, yet supportive fabric that modifies the external appearance of the wearer without putting excess pressure on the wearer's body.

Girdles generally fit around the users waist, hips and upper thighs and are similar to a high-waisted pair of shorts. Some girdles also integrate a brassier that alters the body of the wearer. Wearers generally put on girdles by placing both legs in the leg holes, pulling the girdle up and over their body and pulling the shoulder straps through and over their arms. The wearer then close the bottom of the girdle using a zipper, hook-and-eye enclosures, hooks and loop fasteners, etc. Many girdles also include suspender clips to hold up stockings.

A modern girdle that is used to enhance a woman's figure is presented. It can be used to give the buttocks a lift, contract areas of the body, massage the legs to improve leg ministry, provide body shaping, improve body slimming and stomach control.

The girdle of the present invention can be adjusted while in use and is easily removed. The traversing zippers can be opened slightly or opened significantly down toward the middle of the thighs. In prevailing types of girdles, the wearer might have difficulties removing the girdle after use or for general sanitary purposes. The wearer might also experience a constant need to adjust the fitting and proper suspension of the girdle. The seams of the girdle might gather uncomfortably around the crotch areas or along portions of the leg with simple movements or activity. A wearer is often cautioned to carefully take off a girdle in order to prevent runs or thread damage. In cases where the girdle is small and tight fighting, constant removal of the girdle can damage the skin, internal organs and restrict breathing. The stomach, intestines and other internal organs would be compressed and this can contribute to additional health problems. Some wearers might also refuse to use bathrooms and postpone urination and other sanitary concerns. This contributes to additional health issues including menstrual pain, stress incontinence or exacerbation of an existing health issue.

Using the toilet is also a problem for women who wear girdles and similar garments. Girdles often do not have openings that are sufficient enough to allow a wearer to attend to their sanitary needs. This can further contribute to vaginal health issues including irritation, chafing, fungal infections and urinary tract infections.

With these problems in view, the present invention additionally seeks to achieve as another objective a girdle having a double crotch layer incorporated therewith as an integral portion. The crotch portion of the girdle is formed from two thigh opening sections having closing members that traverse the crotch area and extend downwardly toward the bottom seams of the girdle. The top and bottom crotches are formed when the closing members traverse the left and right sides of the crotch area. The double crotch has a generally rectangular configuration and overlies the crotch area of a user.

The double crotch opening has independent opening mechanisms that can provide access to the crotch and lower abdominal area. The closing members that traverse the top and bottom crotches of the girdle can be moved slightly in a downward position to provide access to the crotch area. This type of access would be helpful in the event that emergency medical care such as pelvic or general wellness exams are performed to evaluate pain or bleeding. A user, clinician or medical health provider would have quick and easy access to the crotch area.

Another object of the present invention is to provide a girdle that can be put on with more accuracy and promotes expedient dressing of the user. The closing members along the inseams are moved to the lower portion of the thighs and opened in order to allow the user to put on the girdle by placing her legs inside of the garment. The top portion of the girdle is immediately placed just above the knee and pulled upwards like a skirt. This avoids the concentration of pressure on the seams or creating a run in the fabric. This also eliminates the need to spend significant time to put on a girdle due to the restriction of movement and the tight nature of a girdle.

Most women utilize shape wear while exercising. The girdle of the present invention can function as a flexible exercise gear and designed specifically for certain exercise programs that involve flexibility, relaxation exercises, running, walking or use of gym equipment. The closing mechanisms can be opened partially or completely and further allow the user to relax the thighs, crotch or abdominal areas, help relieve muscular pain, release compression, quickly tend to a wound or injury or quickly wipe sweat from the body to prevent chafing and rashes.

When the girdle is worn, the traversed areas prevent moisture from building up in the crotch area by providing an opening between the top crotch and bottom crotch. The areas around the crotch can remain dry while the girdle is being worn. This provides a basis for good vaginal care while wearing the girdle. The double crotch provides sanitary protection while giving the illusion of being a single crotch protection.

The girdle can be manufactured in variable sizes and worn by males, females, the elderly, children and athletes in various types of settings.

BRIEF SUMMARY OF THE INVENTION

In view of the foregoing disadvantages associated with the various types of girdles, the present invention seeks to achieve as its principal objective a girdle having a double crotch incorporated therewith as an integral portion and providing additional benefits in the areas of health, wellness and comfort.

The present invention essentially comprises a girdle consisting primarily of left and right thigh members with attached fabric panels. Left and right side closing members are attached to the bottom edges of a top crotch piece and a bottom crotch piece.

A further object of the present invention is to provide a double crotch opening which can be quickly and conveniently opened for affording comfort and for preventing quick and expedient access to the crotch area of a user.

Another object of the present invention is to provide a double crotch opening with independent opening mechanisms that can provide access to the crotch and lower abdominal area.

Another object of the present invention is to provide a girdle that is easy to put on and promotes expedient dressing of an individual. The fasteners positioned along the fabric panels are opened and the top portion of the girdle is immediately placed just above the knee and pulled upwards like a skirt.

Another object of the present invention is to provide a girdle that can release compression by opening traversed closing fasteners. The fasteners can be opened partially or completely and further allow the user to relax the thighs, crotch or abdominal areas.

Another objective of the present objective is to provide a girdle that prevents moisture in the crotch area. When the girdle is worn, the traverses areas prevent moisture from building up in the crotch area by providing an opening between the top crotch and the bottom crotch.

Additional advantages and features of the present invention will become more apparent when considered in light of the following specification and drawings.

DETAILED DESCRIPTION OF THE INVENTION

Figure 1:
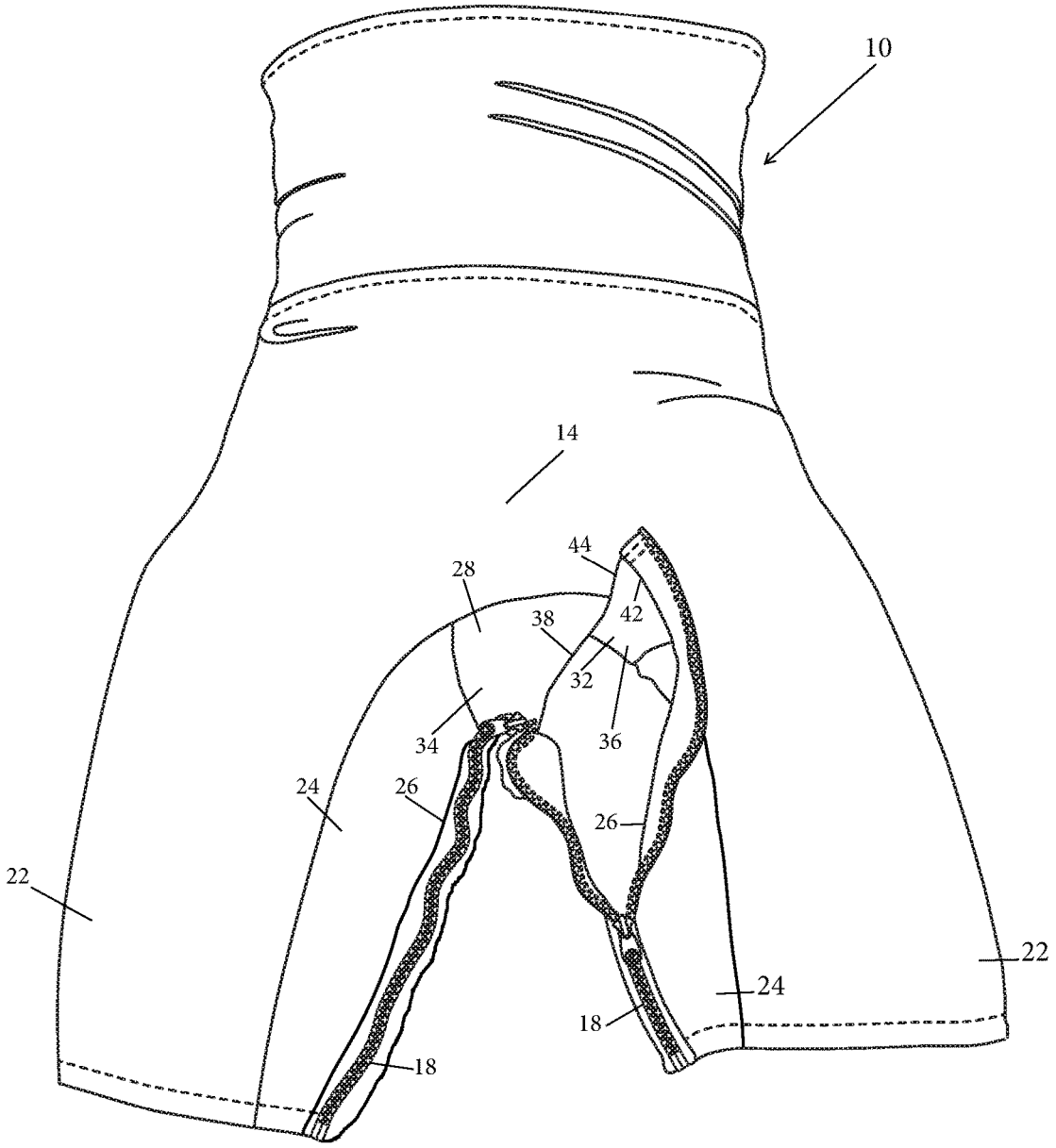
FIG. 1 is a perspective view showing a thigh member being opened.
Figure 2:
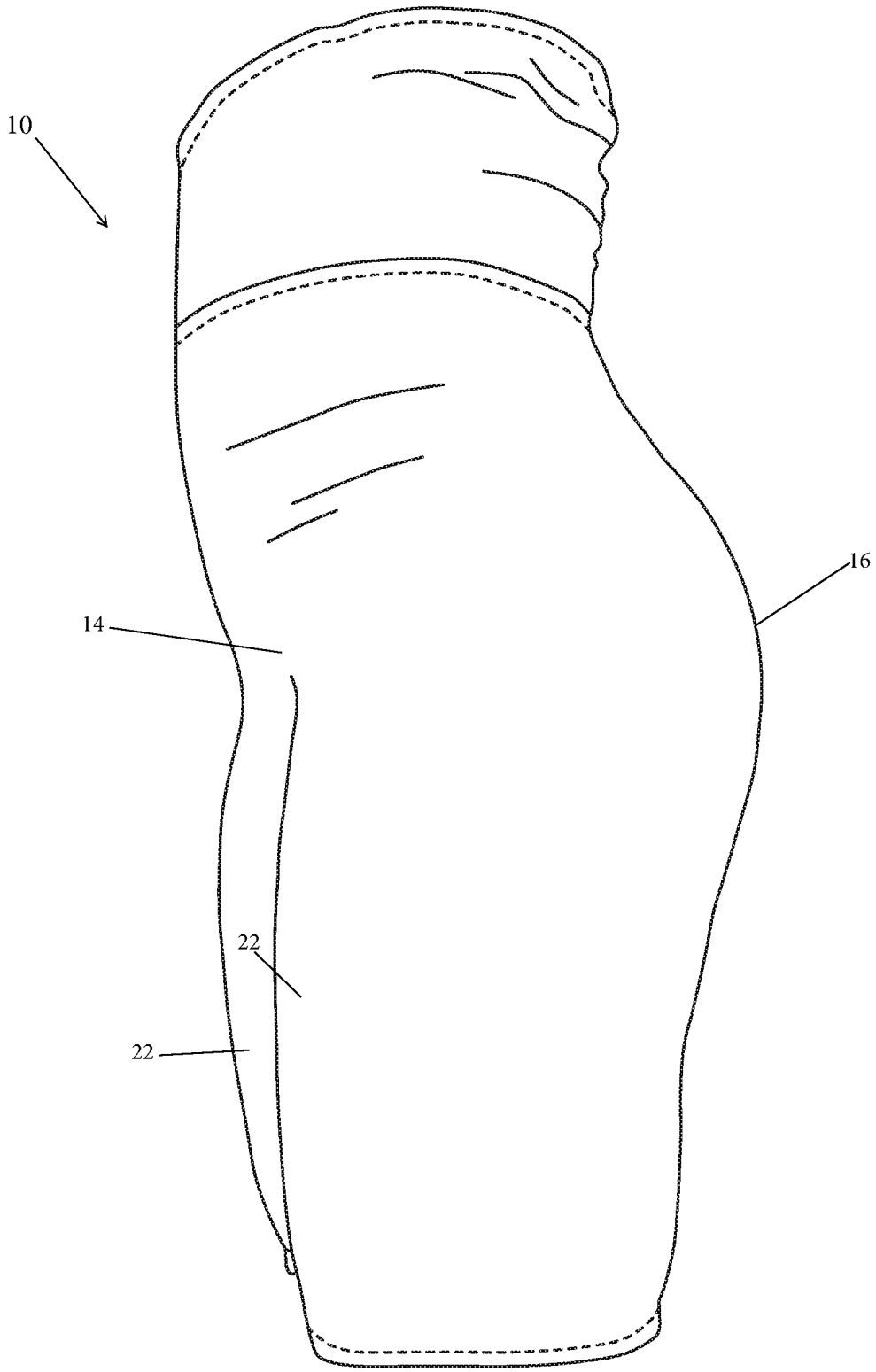
FIG. 2 is a left side view of the girdle.
Figure 3:
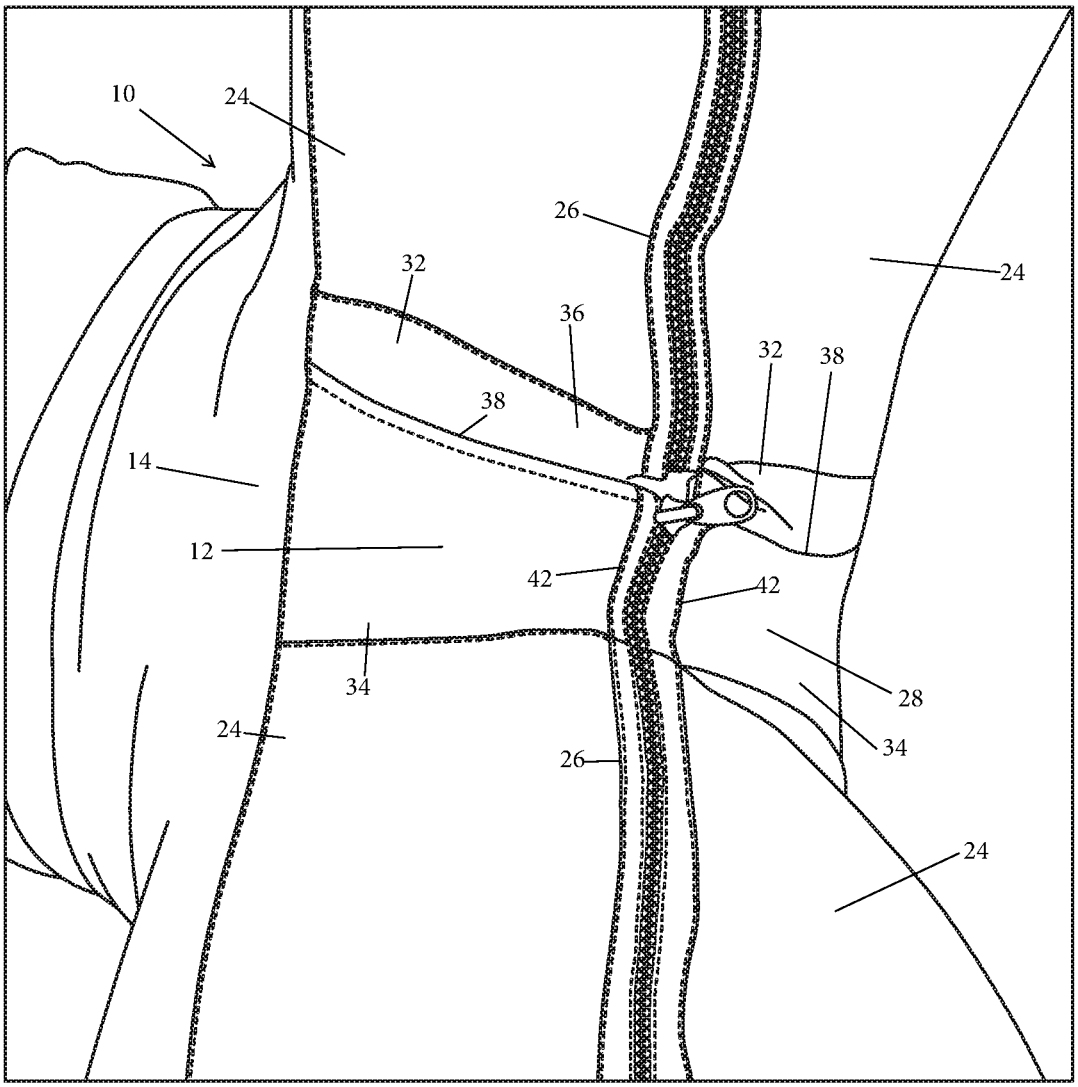
FIG. 3 is an exploded view of the crotch and panel construction of the girdle.
Figure 4:
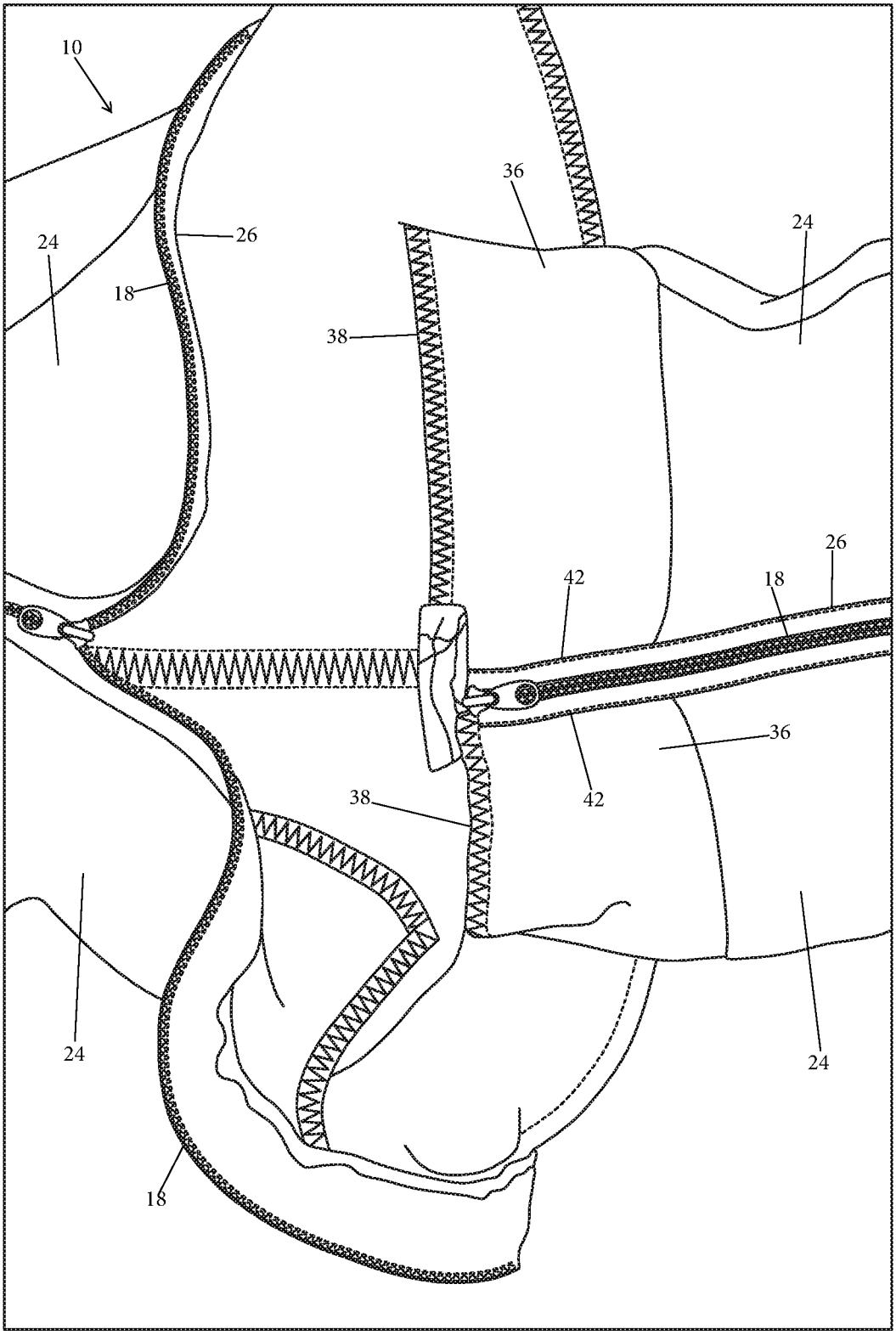
FIG. 4 is an exploded view showing a fastener of the girdle being opened.
Figure 5:
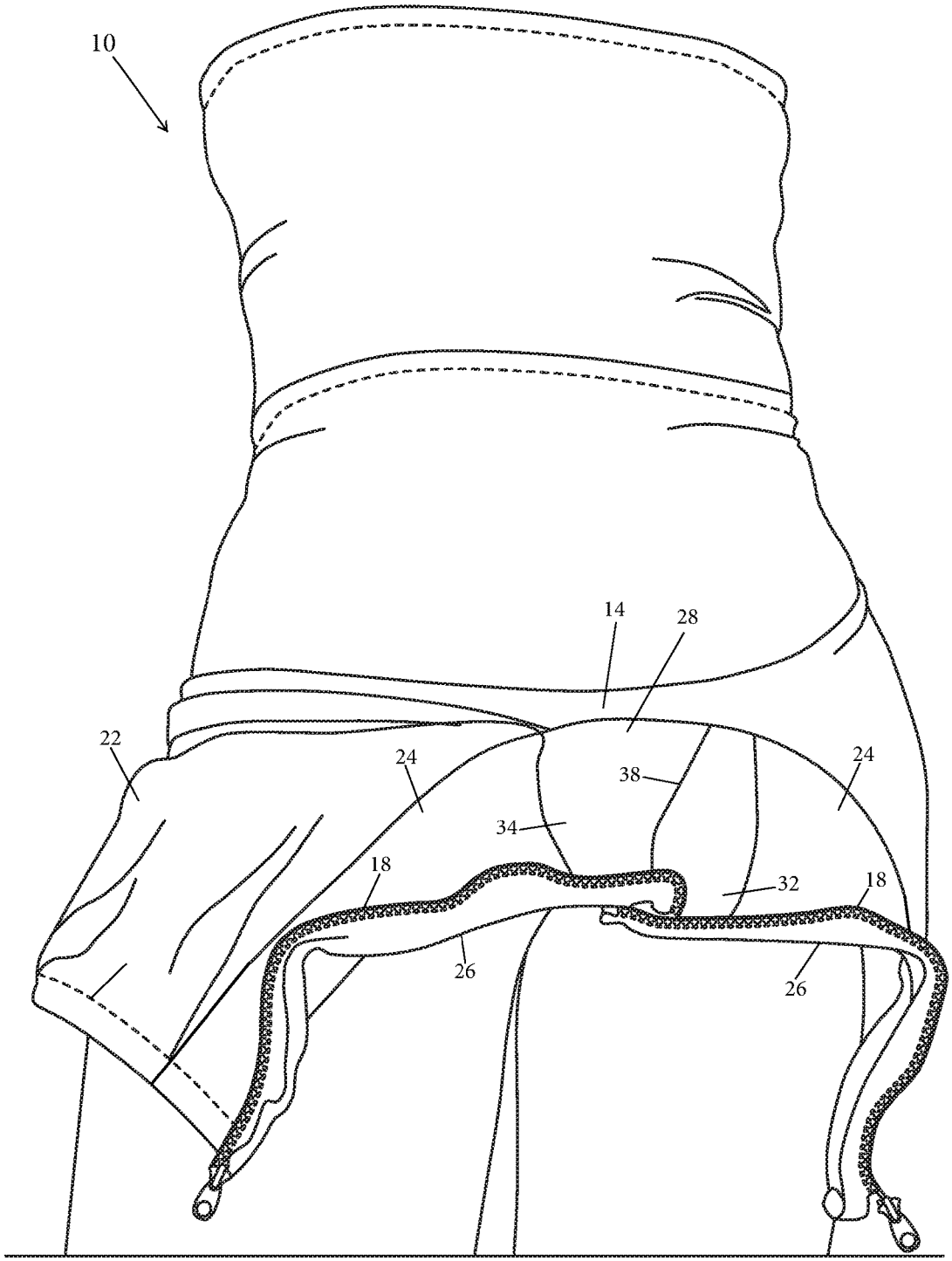
FIG. 5 is a perspective view showing both thigh members being opened.

This form fitting girdle 10 according to several embodiments of this invention provides a unique and functional garment that is comfortable to wear and has an overall attractive appearance. The girdle 10 is constructed from a durable fabric material and features novelty, utility, efficiency of use and practicality. There has been a great demand in the marketplace for shape wear that are comfortable, have flexible compression abilities, promotes proper feminine hygiene and are convenient to use. A form fitting body girdle 10 of a durable material is presented. The girdle 10 having a crotch area 12, a front section 14, a back section 16, and fasteners 18. The form fitting body girdle 10 further comprising thigh members 22 being a part of the front section 14 and the back section 16*m* of the girdle 10 and including thigh member openings 20. The thigh members 22 including fabric panels 24 located on the front of each respective thigh member 22 and the fabric panels 24 having inner edges/inseams 26.

The top crotch piece 28 and the bottom crotch 36 piece have front pieces 34, back pieces 32, free edges 38 and 44, and bottom edges 42. The top crotch piece 28 and the bottom crotch piece 32 are a part of the front section 14 and the back section 16 of the girdle 10. The fasteners 18 are connected to the bottom edges 42 of the top crotch piece 28 and the bottom crotch piece 36. The top crotch 28 piece overlaps the bottom crotch piece 32 when the fasteners 18 are closed.

The top crotch piece 28 and the bottom crotch piece 32 overlap such that the free edges 38 of the top crotch piece 28 overlap the free edges 44 of the bottom crotch piece 32. In an embodiment, the form fitting body girdle of a flexible material comprises:

a front section, a back section, a crotch area section configured to overlie a crotch of a user, and right and left thigh members attached to the crotch area section;

the right and left thigh members being a part of said front section and said back section of said form fitting body girdle and said right and left thigh members each comprising an inner thigh fabric panel extending from said crotch area section to each respective right and left thigh member opening, and a closing fastening member attached to each said right and left thigh members such that each said closing fastening member traverses and extends from said crotch area section to each respective said right and left thigh member opening, wherein each of said closing fastening members divides the front section from the back section of the form fitting body girdle;

the crotch area section further comprising a top crotch piece overlapping a bottom crotch piece, said top crotch piece and said bottom crotch piece each being a part of said front section and said back section of said form fitting body girdle, said top crotch piece and said bottom crotch piece each having front crotch pieces and back crotch pieces, wherein each of said closing fastening members divide the front crotch pieces from the back crotch pieces whereby the front crotch pieces of said top and bottom crotch pieces are a part of said front section of said form fitting body girdle and wherein the back crotch pieces of said top and bottom crotch pieces are a part of said back section of said form fitting body girdle, the front crotch pieces of said top crotch piece and said bottom crotch piece being attached to said inner thigh fabric panels of said right and left thigh members;

a first of said closing fastening members being connected to a bottom edge of the front crotch piece and the back crotch piece of said top crotch piece while being continuously connected to a first inner thigh fabric panel of said inner thigh fabric panels, a second of said closing fastening members being connected to a bottom edge of the front crotch piece and the back crotch piece of said bottom crotch piece while being continuously connected to a second inner thigh fabric panel of said inner thigh fabric panels opposite of said first inner thigh fabric panel of said inner thigh fabric panels;

a first free edge of the front crotch piece and the back crotch piece of said top crotch piece perpendicular to and intersected by said first of said closing fastening members overlapping a second free edge of the front crotch piece and the back crotch piece of said bottom crotch piece perpendicular to and intersected by said second of said closing fastening members, said top crotch piece overlapping said bottom crotch piece when each of said first and second of said closing fastening members are closed creating an opening between the first free edge of said top crotch piece and the second free edge of said bottom crotch piece, the opening configured to provide access to the crotch and a lower abdominal area of the user.

The girdle 10 may be made of any durable fabric used in the production of garments, including but not limited to: cotton, flax, wool, ramie, silk, denim, leather, nylon, polyester, flannel, rayon, Tyvek®, spandex, jute, or hemp. The various fabric and closing member components of the girdle 10 may be attached with thread or adhesives. The design as described herein may be integrated into girdles, sport-wear, swimsuits, body shapers, undergarments, athletic wear, compression clothing and various types of form-fitting garments.

The wearer can close the bottom of the girdle 10 using closing fastening members of a zipper. In construction, various types of closing members can be used. These include hook-and-eye enclosures, hooks and loop fasteners.

The girdle 10 can be constructed to extend from the lower chest to the upper thighs or to incorporate the type of construction that facilitates the use of the garment as a girdle 10 or of the forms listed above. The girdle 10 can be worn as single piece or under clothing to keep the thighs in place and make the process of putting on tight clothing easier.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

What is claimed is:

1. A form fitting body girdle of a flexible material comprising:

a front section, a back section, a crotch area section configured to overlie a crotch of a user, and right and left thigh members attached to the crotch area section;

the right and left thigh members being a part of said front section and said back section of said form fitting body girdle and said right and left thigh members each comprising an inner thigh fabric panel extending from said crotch area section to each respective right and left thigh member opening, and a closing fastening member attached to each said right and left thigh members such that each said closing fastening member traverses and extends from said crotch area section to each respective said right and left thigh member opening, wherein each of said closing fastening members divides the front section from the back section of the form fitting body girdle;

the crotch area section further comprising a top crotch piece overlapping a bottom crotch piece, said top crotch piece and said bottom crotch piece each being a part of said front section and said back section of said form fitting body girdle, said top crotch piece and said bottom crotch piece each having front crotch pieces and back crotch pieces, wherein each of said closing fastening members divide the front crotch pieces from the back crotch pieces whereby the front crotch pieces of said top and bottom crotch pieces are a part of said front section of said form fitting body girdle and wherein the back crotch pieces of said top and bottom crotch pieces are a part of said back section of said form fitting body girdle, the front crotch pieces of said top crotch piece and said bottom crotch piece being attached to said inner thigh fabric panels of said right and left thigh members;

a first of said closing fastening members being connected to a bottom edge of the front crotch piece and the back crotch piece of said top crotch piece while being continuously connected to a first inner thigh fabric panel of said inner thigh fabric panels, a second of said closing fastening members being connected to a bottom edge of the front crotch piece and the back crotch piece of said bottom crotch piece while being continuously connected to a second inner thigh fabric panel of said inner thigh fabric panels opposite of said first inner thigh fabric panel of said inner thigh fabric panels;

a first free edge of the front crotch piece and the back crotch piece of said top crotch piece perpendicular to and intersected by said first of said closing fastening members overlapping a second free edge of the front crotch piece and the back crotch piece of said bottom crotch piece perpendicular to and intersected by said second of said closing fastening members, said top crotch piece overlapping said bottom crotch piece when each of said first and second of said closing fastening members are closed creating an opening between the first free edge of said top crotch piece and the second free edge of said bottom crotch piece, the opening configured to provide access to the crotch and a lower abdominal area of the user.

* * * * *